US008540849B2

(12) United States Patent
Ogiwara

(10) Patent No.: US 8,540,849 B2
(45) Date of Patent: Sep. 24, 2013

(54) PRESS FELT FOR PAPERMAKING

(75) Inventor: Yasuyuki Ogiwara, Tokyo-To (JP)

(73) Assignee: Ichikawa Co., Ltd., Tokyo-To (JP)

( * ) Notice: Subject to any disclaimer, the term of this patent is extended or adjusted under 35 U.S.C. 154(b) by 5 days.

(21) Appl. No.: 13/314,251

(22) Filed: Dec. 8, 2011

(65) Prior Publication Data

US 2012/0145349 A1 Jun. 14, 2012

(30) Foreign Application Priority Data

Dec. 8, 2010 (JP) ..... 2010-288691

(51) Int. Cl.

| | |
|---|---|
| ***D21F 7/08*** | (2006.01) |
| ***D21F 7/10*** | (2006.01) |
| ***B32B 5/26*** | (2006.01) |
| ***D03D 13/00*** | (2006.01) |

(52) U.S. Cl.
USPC ..... 162/358.2; 162/900; 162/903; 162/904; 139/383 AA; 442/270

(58) Field of Classification Search
USPC ..... 162/348, 358.1, 358.2, 900–904; 139/383 A, 383 AA, 425 A; 442/270, 271, 442/205–209; 34/95
See application file for complete search history.

(56) References Cited

U.S. PATENT DOCUMENTS

| | | | | |
|---|---|---|---|---|
| 4,824,525 | A * | 4/1989 | Penven | 162/358.2 |
| 7,384,513 | B2 * | 6/2008 | Eagles | 162/348 |
| 2006/0137845 | A1 | 6/2006 | Ogiwara | |
| 2009/0133774 | A1 | 5/2009 | Ogiwara | |
| 2010/0059135 | A1 | 3/2010 | Ogiwara | |
| 2010/0200188 | A1 | 8/2010 | Ogiwara | |
| 2011/0100576 | A1 | 5/2011 | Ogiwara | |

FOREIGN PATENT DOCUMENTS

| | | | |
|---|---|---|---|
| EP | 2 204 492 | A1 | 7/2010 |
| JP | 2010-100947 | A | 5/2010 |

OTHER PUBLICATIONS

Extended European Search Report issued Apr. 10, 2012 in Patent Application No. 11009698.9.

* cited by examiner

*Primary Examiner* — Eric Hug
(74) *Attorney, Agent, or Firm* — Oblon, Spivak, McClelland, Maier & Neustadt, L.L.P.

(57) ABSTRACT

Press felts for papermaking include a batt fiber layer and a base fabric. The batt fiber layer is integrated into the base fabric. The base fabric includes a ground warp yarn, a ground weft yarn, and an additional warp yarn. The ground warp yarn and the ground weft yarn include monofilament yarns, and the additional warp yarn includes a material different from a material forming the ground warp yarn. The additional warp yarn is arranged so that, when the base fabric is viewed in cross-section in a warp yarn direction, the additional warp yarn ascends toward a wet paper web-side surface of the base fabric and descends toward a roll-side surface of the base fabric, relative to the at least one ground warp yarn.

9 Claims, 7 Drawing Sheets

PRESS FELT FOR PAPERMAKING

CROSS REFERENCE TO RELATED APPLICATION

This application claims priority to Japanese Patent Application No. 2010-288691, filed on Dec. 8, 2010, the disclosure of which is incorporated herein by reference in its entirety.

BACKGROUND

The present invention relates to a press felt for papermaking (which is also called press fabric and hereinafter may be referred to simply as "felt") used in papermaking machines.

In a papermaking process, to remove water from a wet paper web, conventional papermaking machines generally include a wire part, a press part, and a dryer part. The wire part, the press part, and the dryer part are arranged in this order in a wet paper web-transferring direction. The wet paper web is dewatered while being transferred to be sequentially passed on to papermaking apparatuses respectively arranged in the wire part, the press part, and the dryer part, and finally dried in the dryer part.

Each of the parts employs a papermaking apparatus corresponding to its dewatering function. A press apparatus arranged in the press part includes a plurality of press units disposed in series in the wet paper web-transferring direction.

Each of the press units includes an endless felt or a felt in which the ends of an open-ended felt are connected in a papermaking machine to be made into an endless shape, and as a press, a pair of rolls (namely, a roll press) or a roll and a shoe-housing cylindrical belt (namely, a shoe press), which are arranged in opposition at upper and lower positions in such a manner as to sandwich a part of each felt therebetween. A wet paper web transferred to the press unit by the felt running at approximately the same speed in the same direction is subjected to application of pressure by, together with the felt, the rolls or the roll and the shoe-housing cylindrical belt, whereby water is removed from the wet paper web to be successively absorbed by the felt.

Among such papermaking machines, there are, first, a papermaking machine with a roll press mechanism in which a press part includes a press unit for applying pressure to parts of felts holding a wet paper web therebetween by sandwiching the parts thereof between rolls, and, second, a papermaking machine with a shoe press mechanism in which a press part includes a press unit for applying pressure to parts of felts holding a wet paper web therebetween by sandwiching the parts thereof between a roll and a shoe-housing cylindrical belt.

The felt is composed of a base fabric and a batt fiber layer. The batt layer is arranged on both of a wet paper web-side surface and a roll-side surface of the base fabric or only on the wet paper web-side surface thereof. The batt fiber layer is formed by integrally intertwining batt fibers into the base fabric by needle punching. The basic function of the felt is to play the roles of squeezing water out of a wet paper web (water removal), increasing smoothness of the wet paper web, and transferring the wet paper web.

Among the functions of the felt, dewatering the wet paper web, in particular, is given great importance. By passing the wet paper web between a pair of rolls or a roll and shoe mechanism that apply pressure, water is moved from the wet paper web to the felt and the water in the felt is discharged outside the felt system. Therefore, emphasis is placed on maintaining water permeability and compressibility by appropriately securing a spatial volume in the felt.

To appropriately secure the spatial volume in the felt to maintain water permeability and compressibility, endless felts and open-ended felts have been developed in which warp and weft yarns forming base fabrics of the felts are monofilament yarns.

An open-ended felt is a so-called seamed felt. After installing the open-ended felt into a felt run of a papermaking machine, both ends in the length direction (both ends formed in such a manner so as to traverse a felt-running direction) of the felt are connected with each other to form an endless shape, thereby improving workability in felt engagement in the papermaking machine. In the seamed felt, warp yarns forming a base fabric are folded back to form seam loops at both ends in the length direction of the felt to be alternately intermeshed such that respective center holes of the loops are aligned, whereby there is formed a common hole, through which a core line is inserted to connect both ends of the felt.

The warp yarns forming the base fabric of the seamed felt are monofilament yarns so that an appropriate spatial volume can be secured in the felt to maintain water permeability and compressibility as described above. On the other hand, from a different viewpoint, when considering objectives such as retaining a loop shape, intermeshing the loops, and inserting the core line, using monofilament yarns is inevitable.

However, when monofilament yarns are used as warp and weft yarns forming the base fabric of a felt, the task of intertwining of monofilament yarns forming the base fabric and the batt fibers by needle punching is delicate. As a result, shedding of batt fibers occurs during use of the felt, a phenomenon called dehairing.

The dehairing phenomenon causes various problems. For example, transferability of a wet paper web is disturbed and the shed batt fibers adhere to the wet paper web, causing a paper printing problem. In addition, due to the shedding of the batt fibers, physical properties of the felt, such as water removability and water permeability, are changed to destabilize the operation of papermaking, and also, warp and weft yarns of the wet paper web-side surface or the roll-side surface of the base fabric are exposed, which accelerates the abrasion of the base fabric to reduce the strength thereof, resulting in shortening of the felt life.

In addition, since monofilament yarn has excellent flattening-resistant characteristics, it appropriately secures a spatial volume in felt. Meanwhile, intersections between the warp yarns and the weft yarns of a base fabric, that is, knuckle portions are emphatic. Thus, another problem occurs in which during dewatering, the emphatic knuckle portions are transcribed to the wet paper web to cause reduction in surface smoothness of the wet paper web (paper mark).

Furthermore, by using monofilament yarns as warp and weft yarns forming the base fabric of the felt, the yarns slip against each other because of smoothed surfaces of the monofilament yarns, whereby the warp yarns project from the felt surface or shed during the use of the press felt.

To prevent dehairing of batt fibers of a felt and improve the smoothness of a wet paper web, various felts have been proposed.

JP-A-2009-68153 proposes a felt using a base fabric made of multifilament yarns each formed by bundling a plurality of pieces of filaments having a fineness of 100 dtex or lower as at least one of a warp yarn and a weft yarn arranged on a wet paper web-side of the base fabric.

As an example of the felt described in JP-A-2009-68153, a felt has been described including a laminate structure formed by overlapping two base fabrics: a wet paper web-side base fabric and a roll-side base fabric. Usually, in the laminate structure, the two base fabrics are woven, subjected to thermal setting to adjust to an appropriate size difference, and then bonded together. Upon bonding together, the base fabrics may not be able to be bonded to each other due to a size difference between them. In this case, thermal setting is needed again, so that employing the laminate structure is very costly.

In addition, employing multifilament yarns as the warp or weft yarns of the base fabric arranged on the wet paper web-side is not very effective in the prevention of shedding of batt fibers on the roll-side surface, although it can prevent shedding of batt fibers on the wet paper web-side surface.

JP-A-2010-196206 proposes a felt in which a base body is made of a plurality of reinforcing materials, and the reinforcing material on a wet paper web-side surface adjacent to a wet paper web-side batt layer or the reinforcing material on a roll-side surface adjacent to a roll-side batt layer includes a spun yarn that is integrated into the base fabric to such an extent that yarn configuration for intertwining the spun yarn with each batt layer disappears.

The base fabric of the felt described in JP-A-2010-196206 also has a laminate structure. Thus, production cost is very high, as in the felt described in JP-A-2009-68153. Additionally, due to the incorporation of a spun yarn whose yarn configuration disappears into the base fabric, there is a possibility that compressibility of the base fabric is inhibited.

JP-A-2010-100947 proposes a felt in which a base fabric has a multilayer structure obtained by laminating layers of a plurality of ground warp yarns formed of monofilament yarns such that the yarns overlap each other in a thickness direction of the cloth, and an additional warp yarn made of a yarn material different from that of the ground warp yarns forms only the layer(s) of the ground warp yarns on a papermaking face-side and/or a running face-side to be interwoven in such a manner as if floating and sinking on a surface of the base fabric on the papermaking face-side or the running face-side.

However, in the felt described in JP-A-2010-100947, the additional warp yarn arranged only on the papermaking face-side is likely to cause fiber shedding on the running face-side. Conversely, when the additional warp yarn is arranged only on the running face-side, fiber shedding is likely to occur on the papermaking face-side.

Furthermore, in a seamed felt in which an additional warp yarn is arranged on both of the papermaking face-side and the running face-side, as disclosed in JPA-2010-100947, upon core-line replacement (such as the replacement of a core line damaged by needling when batt fibers are integrally intertwined into a base fabric by the needling) and felt splitting at a seam portion (such as the cutting of a bottom batt fiber layer of the seam portion, the removal of the batt fibers entangled with seam loops, and the cutting of a top batt fiber layer of a seam portion, which are a so-called flap processing), the additional warp yarn is connected to upper and lower parts of the seam portion. Thereby, the seam loops cannot be seen due to the presence of the additional warp yarn, and the seam portion cannot be opened, which significantly increases working steps. In addition, when cutting the additional warp yarn, there was a possibility of damage to the seam loops, resulting in cutting down of them.

SUMMARY

It is an object of the present invention to provide endless and open-ended felts that use monofilament yarns as warp and weft yarns forming base fabrics of the felts to appropriately secure a spatial volume in the felts so as to maintain water permeability and compressibility, in such a manner that eliminates a problem of fiber shedding on both of a wet paper web-side surface and a roll-side surface. It is a further object of the present invention to provide such felts without significantly increasing working steps or changing the physical properties of the base fabrics of the felts. The foregoing objects are not achieved by conventional techniques.

To solve the above problems, embodiments of the present invention include an additional warp yarn made of a yarn material different from that of ground warp yarns in a base fabric interwoven into the base fabric.

Various exemplary embodiments of the present invention include the following.

(1) A press felt for papermaking wherein a batt fiber layer is integrated into a base fabric, wherein the base fabric has a multiple structure forming a wet paper web-side surface and a roll-side surface, wherein a ground warp yarn and a ground weft yarn of the base fabric are monofilament yarns, and an additional warp yarn made of a material different from that of the ground warp yarns is arranged between the ground warp yarns to be interwoven in such a manner that the additional warp yarn is floating and sinking on both of the wet paper web-side surface and the roll-side surface.

(2) The press felt for papermaking according to (1), wherein the additional warp yarn is made of a yarn assembly material obtained by assembling in large numbers one of or both of a staple yarn and a filament yarn.

(3) The press felt for papermaking according to (1) or (2), wherein the ground warp yarns are folded back at an end in the length direction of the felt to form an end connection loop.

(4) The press felt for papermaking according to (3), wherein, the additional warp yarn is entirely arranged on the wet paper web-side surface at the connection loop portion.

(5) The press felt for papermaking according to (3), wherein the additional warp yarn is entirely arranged on the roll-side surface at the connection loop portion.

(6) The press felt for papermaking according to (3), wherein the additional warp yarn is folded back at least one of weft yarns near the connection loop portion.

(7) The press felt for papermaking according to (1) or (2), wherein the additional warp yarn is folded back at an end in a length direction of the felt to form an end connection loop.

(8) A press felt for papermaking wherein a batt fiber layer is integrated into a base fabric, wherein the base fabric has a multiple structure forming a wet paper web-side surface and a roll-side surface, wherein a ground warp and a ground weft yarns of the base fabric are monofilament yarns, wherein the ground warp yarn is folded back at an end in the length direction of the felt to form an end connection loop, and an additional warp yarn made of a material different from that of the ground warp yarn is arranged between the ground warp yarns to be interwoven in such a manner that the additional warp yarn is floating and sinking on the wet paper web-side surface and/or the roll-side surface and is folded back at least one of weft yarns near the loop portion.

(9) A press felt for papermaking wherein a batt fiber layer is integrated into a base fabric, wherein the base fabric has a multiple structure forming a wet paper web-side surface and a roll-side surface, wherein a ground warp and a ground weft yarn of the base fabric are monofilament yarns, wherein the ground warp yarn is folded back at an end in the length direction of the felt to form end connection loops and wherein an additional warp yarn made of a material different from that of the ground warp yarn is arranged between the ground warp yarns to be interwoven in such a manner that the additional warp yarn is floating and sinking on the wet paper web-side surface and/or the roll-side surface and is folded back at the end in the length direction of the felt to form an end connection loop.

As described above, in embodiments of the present invention, fibers of the batt fiber layer are intertwined with the additional warp yarn exposed on the wet paper web-side surface and the roll-side surface of the base fabric, which can eliminate a fiber shedding problem on both the wet paper web-side surface and the roll-side surface, which is a defect in conventional techniques. In addition, the additional warp yarn may be interwoven when weaving, which can prevent increases in working steps and significant changes in the physical properties of the base fabric of the felt in a laminate structure including a plurality of base fabrics bonded together.

Furthermore, in embodiments of the present invention, in core line replacement of seamed felts and splitting felts at a seam portion, working steps can be reduced and the work can be easily conducted without any damage to the seam loops, since no additional warp yarn is present on at least one of the wet paper web face-side and the roll face-side of the seam portion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF EXEMPLARY EMBODIMENTS

Figure 1:
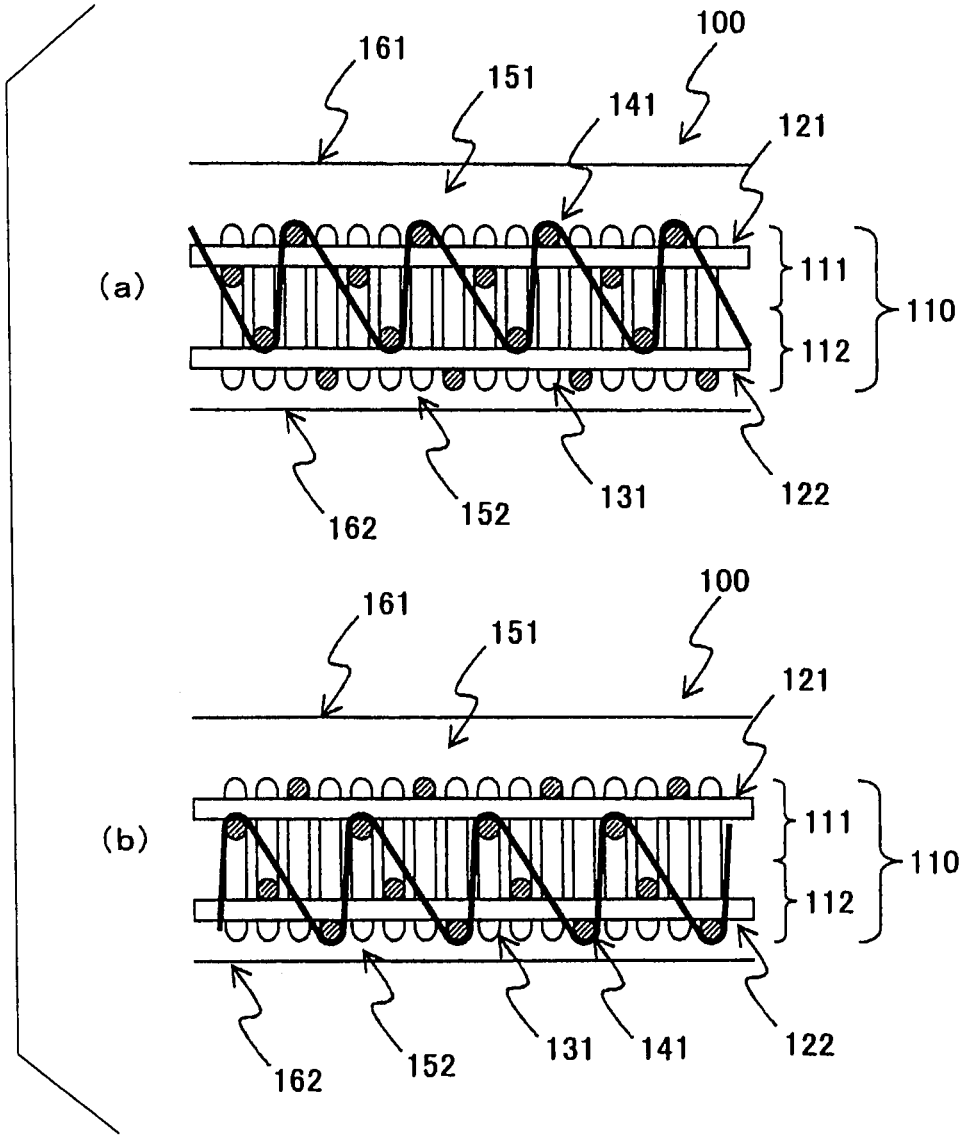
FIG. 1 is a cross-sectional view in a length direction of an exemplary press felt for papermaking according to the present invention.

Referring now to the drawings, wherein like reference numerals designate identical or corresponding parts throughout the several views.

FIGS. 1(*a*) and 1(*b*) are cross-sectional views in a length direction showing one example of a press felt for papermaking according to the present invention. The felt 100 is formed by integrally laminating a top batt fiber layer 151 on a wet paper web-side surface 161 of a base fabric 110 and a bottom batt fiber layer 152 on a roll-side surface 162 thereof by needling. The base fabric 110 has a warp double structure in which a ground warp yarn 121 on the wet paper web-side surface and a ground warp yarn 122 on the roll-side surface overlap each other in its thickness direction to form a laminate of a wet paper web-side layer 111 and a roll-side layer 112 by the respective upper and lower ground warp yarns 121 and 122.

A raw material to be used for the ground warp yarns 121 and 122 can be polyamide, aromatic polyamide, polyolefin, acryl, polyester, or the like. Particularly, polyamide, which is excellent in strength and durability, is suitably used. The warp yarns may have a thickness of 500 to 3000 dtex, and preferably of 900 to 2000 dtex. Yarn density may be 50 to 120 pieces/5 cm. Additionally, a raw material suitably used for a ground weft yarn 131 is polyamide, as in the ground warps. Weft yarn thickness may be 500 to 2700 dtex, and preferably 800 to 1600 dtex, and weft yarn density may be 40 to 130 pieces/5 cm.

Additionally, in the base fabric 110, in addition to the ground warp yarns 121 and 122, an additional warp yarn 141 is arranged in such a manner so as to interweave the wet paper web-side layer 111 of the base fabric and the roll-side layer 112 thereof. In this manner, fibers forming the top batt fiber layer 151 and the bottom batt fiber layer 152 twine themselves around the ground warp yarns 121 and 122, the ground weft yarn 131, and also the additional warp yarn 141, so that the fibers forming the top batt fiber layer 151 and the bottom batt fiber layer 152 can be firmly retained in the base fabric, allowing for the prevention of fiber shedding. The additional warp yarn 141 to be arranged with respect to the ground warp yarns 121 and 122 may be a single one, or a single additional warp yarn 141 may be arranged with respect to a plurality of pieces of the ground warp yarns 121 and 122, for example, four pieces thereof. Furthermore, the additional warp yarn 141 may be arranged so as to have at least one or both of the forms shown in FIGS. 1(*a*) and 1(*b*).

As the additional warp yarn 141, a monofilament formed of a single filament can be used. However, from the viewpoint of preventing shedding of the fibers forming the top batt layer 151 and the bottom batt layer 152, it is preferable to use a yarn assembly material, such as monofilament twisted yarn, multifilament, multifilament twisted yarn, or spun yarn (yarn made by spinning staples (short fibers)). In addition, when using a twisted yarn including a fabric made of a thermofusible material, by performing heat treatment after integrally intertwining the top batt fiber layer 151 and the bottom batt fiber layer 152 with the weaved base fabric 110 by needling, the thermofusible material of the additional warp yarn 141 is fused to be adhered to the fibers forming the batt fiber layer, thereby exhibiting higher resistance to fiber shedding. Furthermore, when the additional warp yarn 141 is a monofilament yarn, accumulation of stains in the felt can be prevented.

In addition, the additional warp yarn 141 is formed of a thinner yarn material than the ground warp yarns 121 and 122. For example, when the additional warp yarn 141 is a monofilament yarn, a yarn thickness thereof may be 200 to 800 dtex. When the warp yarn 141 is a monofilament twisted yarn, it may be a yarn made by twisting together 2 to 6 pieces of filaments having a thickness of 100 to 500 dtex. Furthermore, in the case of a multifilament yarn, the warp yarn 141 may be a bundle of 20 to 300 pieces of filaments having a thickness of 4 to 50 dtex. Yarn density of each case as above may be 12 to 120 pieces/5 cm. When a plurality of additional warp yarns 141 are arranged between the ground warp yarns, a total fiber fineness (yarn thickness) of the plurality of additional warp yarns arranged may be equal to that of the ground warp yarns, and preferably a half of that thereof.

Figure 2:
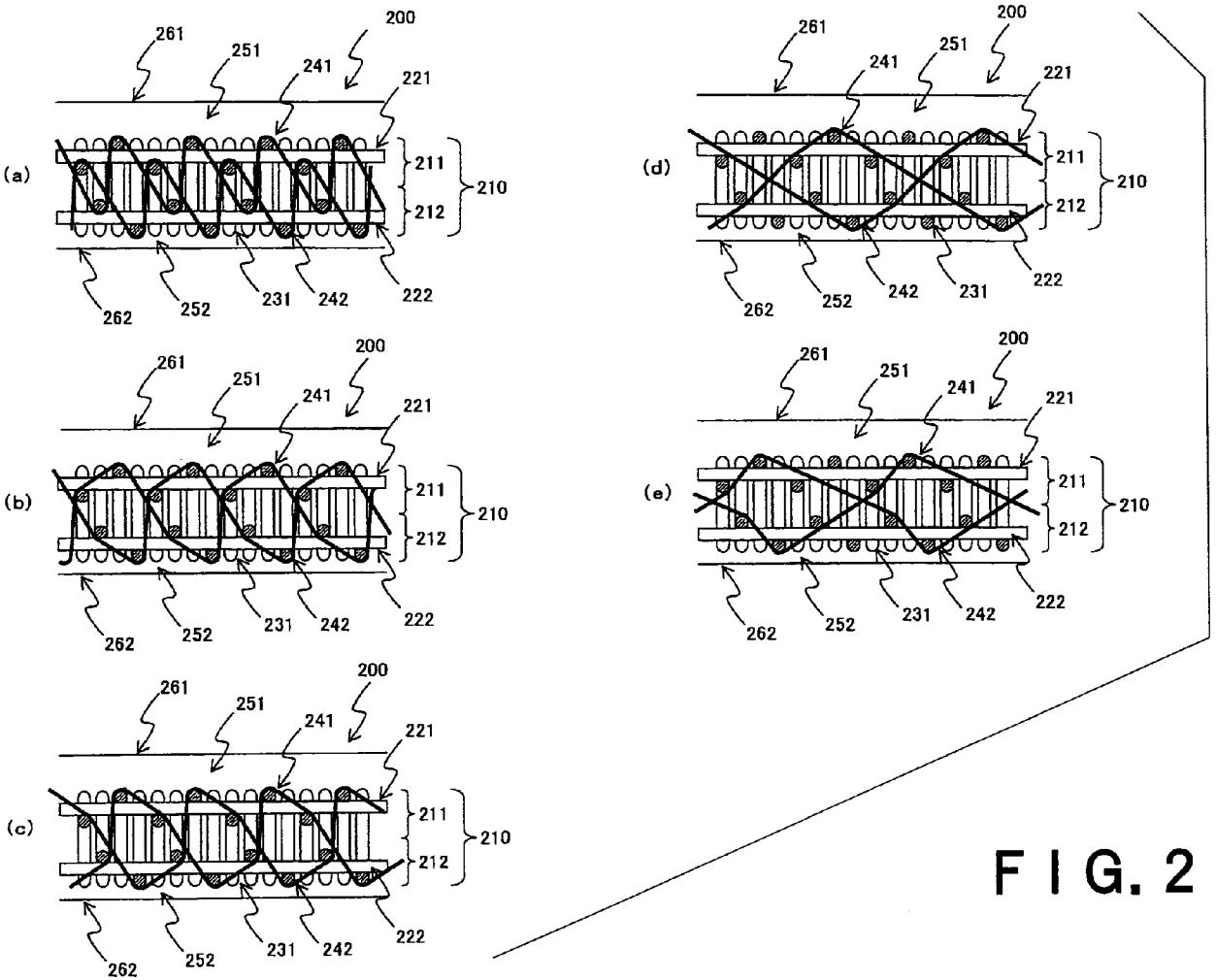
FIG. 2 is a cross-sectional view in the length direction of a further exemplary press felt for papermaking according to the present invention.

FIGS. 2(*a*) to 2(*e*) are cross-sectional views in the length direction showing another example of a press felt for papermaking according to the present invention. The felt 200 is formed by integrally laminating a top batt fiber layer 251 on a wet paper web-side surface 261 of a base fabric 210 and a bottom batt fiber layer 252 on a roll-side surface 262 thereof by needling. The base fabric 210 has a warp double structure in which a ground warp yarn 221 on the wet paper web-side surface and a ground warp yarn 222 on the roll-side surface overlap each other in its thickness direction to form a laminate of a wet paper web-side layer 211 and a roll-side layer 212 by the respective upper and lower ground warp yarns 221 and 222.

In the structure shown in FIGS. 2(*a*) to 2(*e*), there are arranged two additional warp yarns with respect to the ground warp yarns, although, in FIGS. 1(*a*) and 1(*b*), the single additional warp is arranged with respect to the ground warp yarns 121 and 122. The structure can further prevent the shedding of fibers forming the top batt fiber layer 251 and the bottom batt fiber layer 252.

Figure 3:
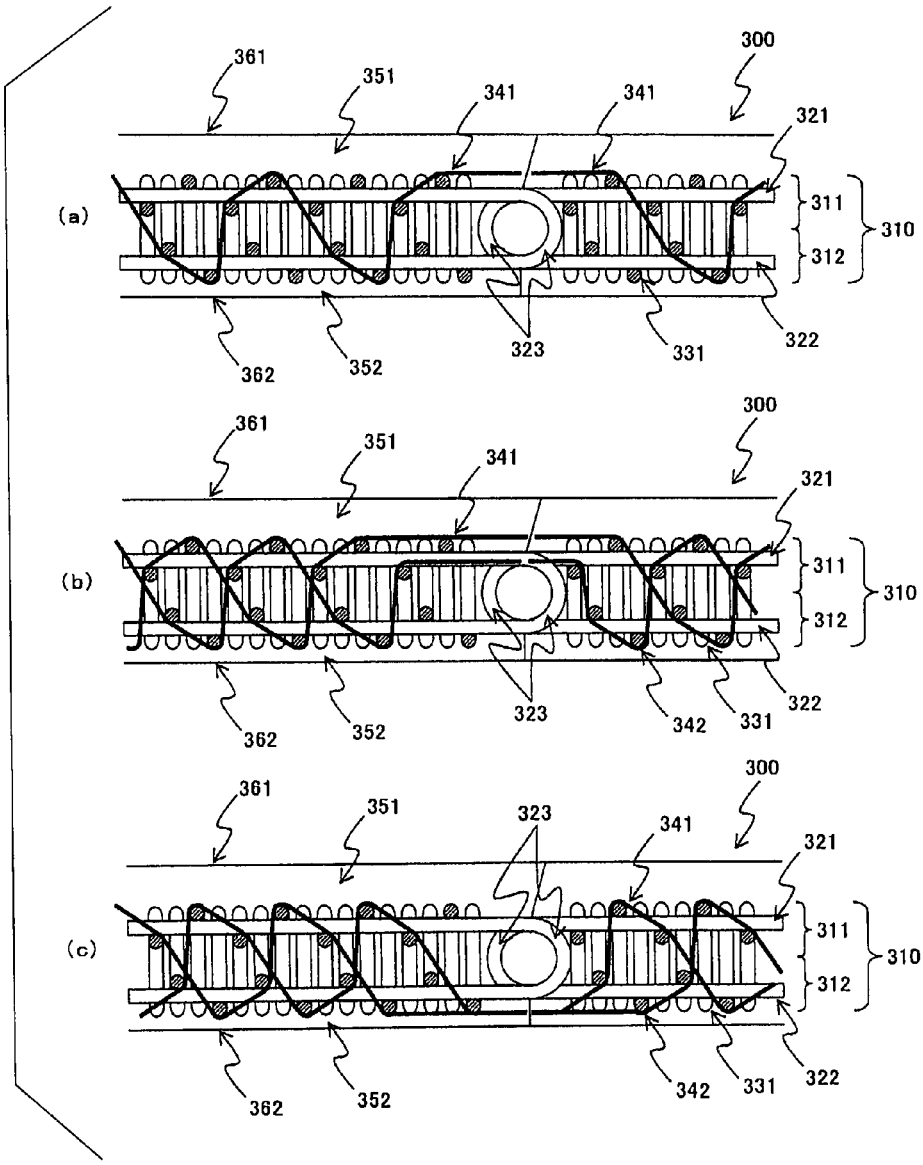
FIG. 3 is a cross-sectional view in the length direction of a further exemplary press felt for papermaking according to the present invention.

FIGS. 3(*a*) to 3(*c*) are cross-sectional views in the length direction showing another example of a press felt for papermaking according to the present invention. The felt 300 is formed by integrally laminating a top batt fiber layer 351 on a wet paper web-side surface 361 of a base fabric 310 and a bottom batt fiber layer 352 on a roll-side surface 362 thereof by needling. The felt 300 is a seamed felt in which, in the base fabric 310, a yarn used as ground warp yarns 321 and 322 is folded back to form an end connection loop 323 at each end in the length direction. The seamed felt is structured such that, after setting between rolls of a papermaking machine, the end connection loops 323 are meshed with each other to form a common hole, through which a core line is inserted to connect endlessly. The base fabric 310 has a warp double structure in which the ground warp yarn 321 on the wet paper web-side surface 361 and the ground warp yarn 322 on the roll-side surface 362 overlap each other in its thickness direction to form a laminate of a wet paper web-side layer 311 and a roll-side layer 312 by the respective upper and lower ground warp yarns 321 and 322.

Additionally, in the base fabric 310, in addition to the ground warp yarns 321 and 322, a single additional warp yarn 341 or two additional warp yarns 341 and 342 are arranged with respect to the ground warp yarns 321 and 322 in such a manner so as to interweave the wet paper web-side layer 311 and the roll-side layer 312 of the base fabric. Thereby, fibers forming the top batt fiber layer 351 and the bottom batt fiber layer 352 twine themselves around the ground warp yarns 321, 322, a ground weft yarn 331, and furthermore, the additional warp yarn 341 or the additional warp yarns 341, 342 to be firmly retained in the base fabric, allowing for the prevention of fiber shedding.

Furthermore, since the additional warp yarn 341 or the additional warp yarns 341 and 342 interweave the wet paper web-side layer 311 and the roll-side layer 312 of the base fabric, the ground warp yarns 321 and 322 are firmly fixed.

Still furthermore, regarding the additional warp yarn 341 or the additional warp yarns 341 and 342, no additional warp yarn is present on one face of a wet paper web face-side and a roll face-side of a seam portion, and thus, the one face thereof is opened by pulling out the core line, which facilitates opening of the seam portion. Therefore, core line replacement in the seamed felt and felt splitting at the seam portion do not require many working steps and can be easily carried out without damage to the seam loops. Additionally, as in FIG. 3(*c*), when the additional warp yarns 341 and 342 are arranged on the roll face-side of the seam portion, the ground warp yarns may be cut before integrally laminating the top batt fiber layer 351 and the bottom batt fiber layer 352 by needling, that is, when the base fabric 310 is present alone.

Figure 4:
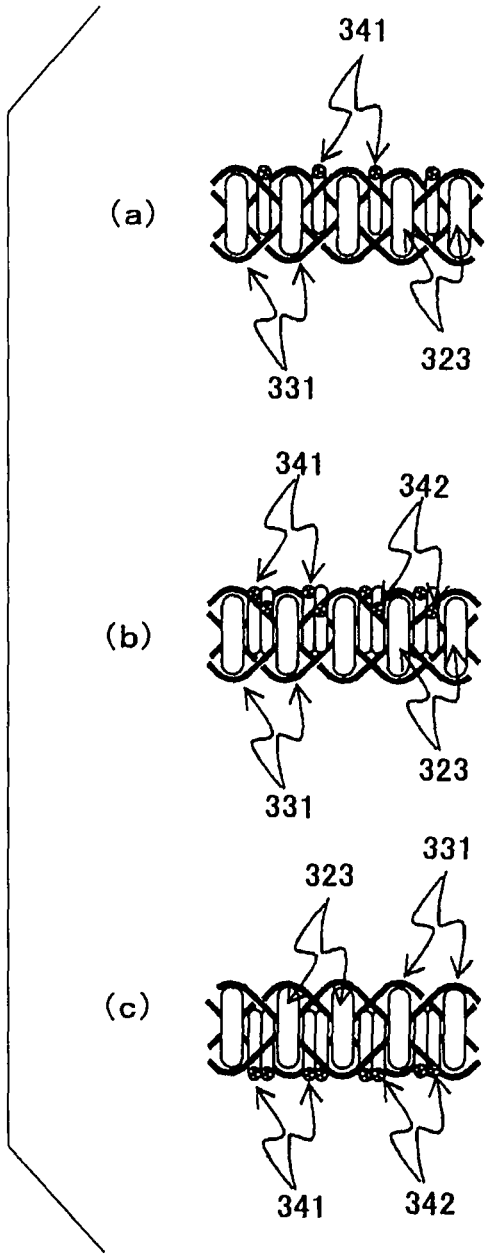
FIG. 4 is a cross-sectional view in a width direction of a seam portion of the press felt for papermaking shown in FIG. 3.

FIGS. 4(*a*) to 4(*c*) are cross-sectional views in a width direction of the seam portions shown in FIGS. 3(*a*) to 3(*c*). FIG. 4(*a*) shows an arrangement in which, between the loops is arranged the single additional warp yarn 341 on the wet paper web-side surface 361, and FIGS. 4(*b*) and 4(*c*) show an arrangement in which, between the loops are arranged the two additional warp yarns 341 and 342 on the wet paper web-side surface 361 or the roll-side surface 362.

Figure 5:
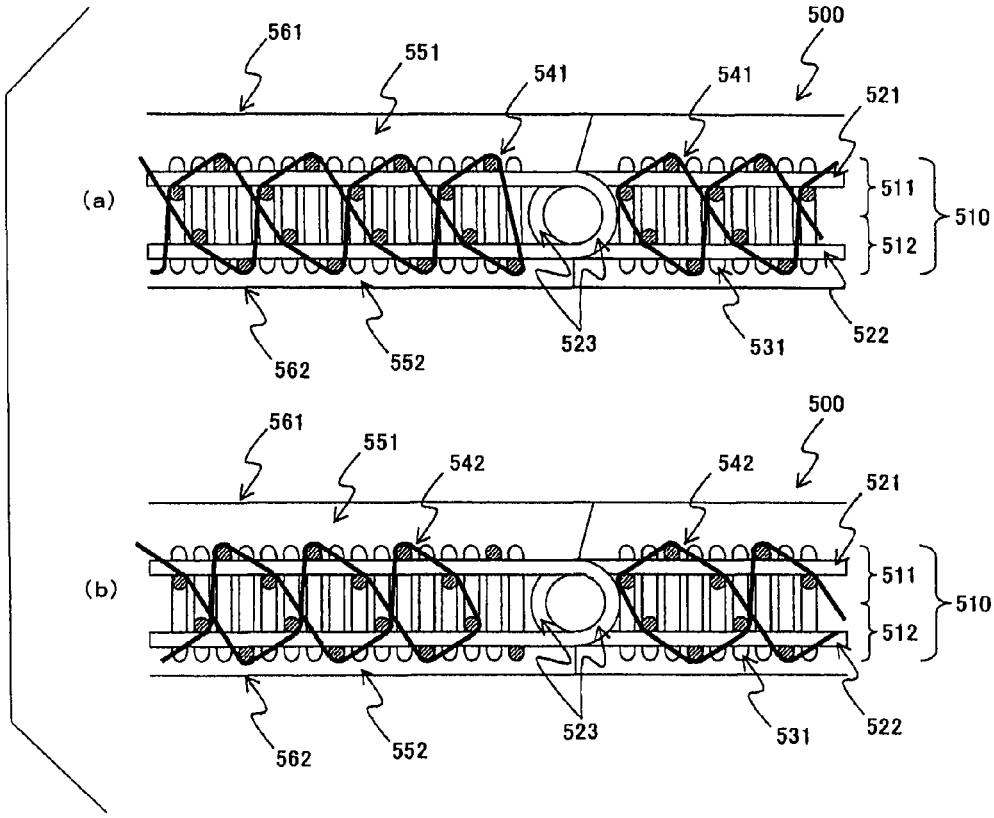
FIG. 5 is a cross-sectional view in the length direction of a further exemplary press felt for papermaking according to the present invention.

FIGS. 5(*a*) and 5(*b*) are cross-sectional views in the length direction showing another example of a press felt for papermaking according to the present invention. The felt 500 is formed by integrally laminating a top batt fiber layer 551 on a wet paper web-side surface 561 of a base fabric 510 and a bottom batt fiber layer 552 on a roll-side surface 562 thereof by needling. The felt 500 is a seamed felt in which, in the base fabric 510, a yarn used as ground warp yarns 521 and 522 is folded back to form an end connection loop 523 at each end in the length direction. The seamed felt is structured such that, after setting between the rolls of the papermaking machine, the end connection loops 523 are meshed with each other to form a common hole, through which a core line is inserted to connect endlessly. The base fabric 510 has a warp double structure in which the ground warp yarn 521 on the wet paper web-side surface 561 and the ground warp yarn 522 on the roll-side surface 562 overlap each other in its thickness direction to form a laminate of a wet paper web-side layer 511 and a roll-side layer 512 by the respective upper and lower ground warp yarns 521 and 522.

Additionally, in the base fabric 510, in addition to the ground warp yarns 521 and 522, an additional warp yarn 541 or 542 is arranged in such a manner so as to interweave the wet paper web-side layer 511 and the roll-side layer 512 of the base fabric. Thereby, fibers forming the top batt fiber layer 551 and the bottom batt fiber layer 552 twine themselves around the ground warp yarns 521, 522, a ground weft yarn 531, and furthermore, the additional warp yarn 541 or 542 to be firmly retained in the base fabric, allowing for the prevention of fiber shedding.

Furthermore, since the additional warp yarn 541 or the additional warp yarn 542 interweaves the wet paper web-side layer 511 and the roll-side layer 512 of the base fabric, the ground warp yarns 521 and 522 are firmly fixed.

Still furthermore, the additional warp yarn 541 or the additional warp yarn 542 is folded back at least one of weft yarns near the connection loop portion and is not connected at the seam portion. Thereby, when splitting the felt at the seam portion, it is unnecessary to cut the additional warp yarn 541 or 542, and also since the seam portion can be easily opened, felt splitting (flap processing) efficiency can be significantly improved.

Figure 6:
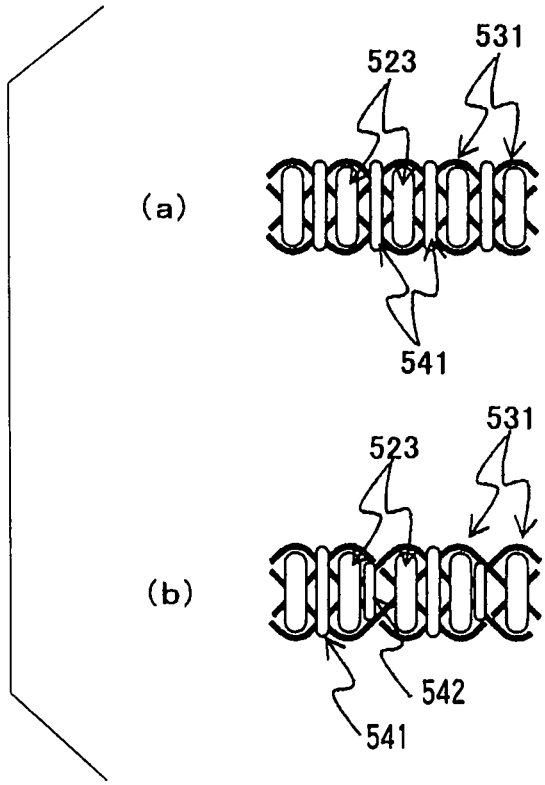
FIG. 6 is a cross-sectional view in the width direction of a seam portion of the press felt for papermaking shown in FIG. 5.

FIGS. 6(*a*) and 6(*b*) are cross-sectional views in the width direction of the seam portions shown in FIGS. 5(*a*) and 5(*b*). FIG. 6(*a*) shows an arrangement in which, in FIG. 5(*a*), between the loops is arranged the additional warp yarn 541 in such a manner so as to being folded back from outsides of the wet paper web-side layer 511 and the roll-side layer 512. FIG. 6(*b*) shows a composite system of FIGS. 5(*a*) and 5(*b*), in which, between the loops are alternately arranged the additional warp yarn 541 arranged such that it is folded back from the outsides of the wet paper web-side layer 511 and the roll-side layer 512 and the additional warp yarn 542 arranged such that it is folded back from insides of the wet paper web-side layer 511 and the roll-side layer 512.

Figure 7:
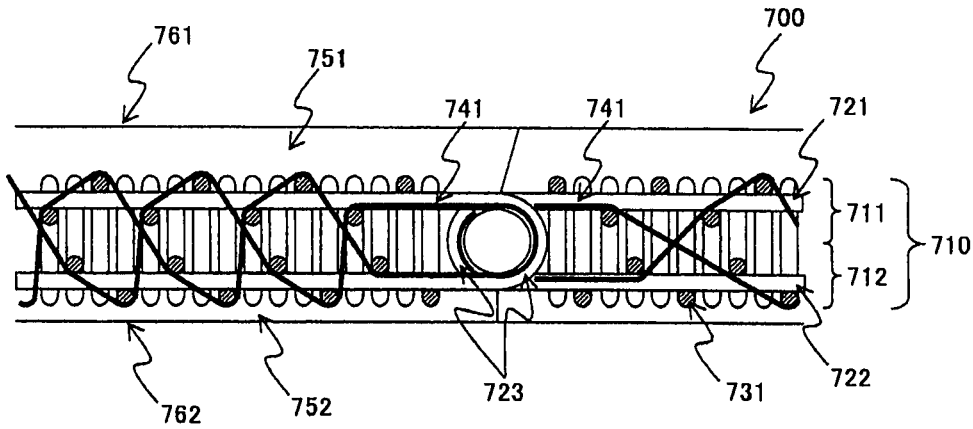
FIG. 7 is a cross-sectional view in the length direction of a further exemplary press felt for papermaking according to the present invention.

FIG. 7 is a cross-sectional view in the length direction showing another example of the press felt for papermaking according to the present invention. The felt 700 is formed by integrally laminating a top batt fiber layer 751 on a wet paper web-side surface 761 of a base fabric 710 and a bottom batt fiber layer 752 on a roll-side surface 762 thereof by needling. The felt 700 is a seamed felt in which, in the base fabric 710, a yarn used as ground warp yarns 721 and 722 is folded back to form an end connection loop 723 at each end in the length direction. The seamed felt is structured such that, after setting between the rolls of the papermaking machine, the end connection loops 723 are meshed with each other to form a common hole, through which a core line is inserted to connect endlessly. The base fabric 710 has a warp double structure in which the ground warp yarn 721 on the wet paper web-side surface 761 and the ground warp yarn 722 on the roll-side surface 762 overlap each other in its thickness direction to form a laminate of a wet paper web-side layer 711 and a roll-side layer 712 by the respective upper and lower ground warp yarns 721 and 722.

Additionally, in the base fabric 710, in addition to the ground warp yarns 721 and 722, an additional warp yarn 741 is arranged in such a manner so as to interweave the wet paper web-side layer 711 and the roll-side layer 712 of the base fabric. Thereby, fibers forming the top batt fiber layer 751 and the bottom batt fiber layer 752 twine themselves around the ground warp yarns 721, 722, a ground weft yarn 731, and furthermore, the additional warp yarn 741 to be firmly retained in the base fabric, allowing for the prevention of fiber shedding. Furthermore, since the additional warp yarn 741 is arranged on both sides of the wet paper web-side layer 711 and the roll-side layer 712 of the connection loops 723, fiber shedding can be prevented also at the loop portion.

Furthermore, since the additional warp yarn 741 interweaves the wet paper web-side layer 711 and the roll-side layer 712 of the base fabric, the ground warp yarns 721 and 722 are firmly fixed.

Still furthermore, since the additional warp yarn 741, together with the ground warp yarns 721 and 722, forms the connection loops 723, strength of the loops can be greatly increased.

Figure 8:
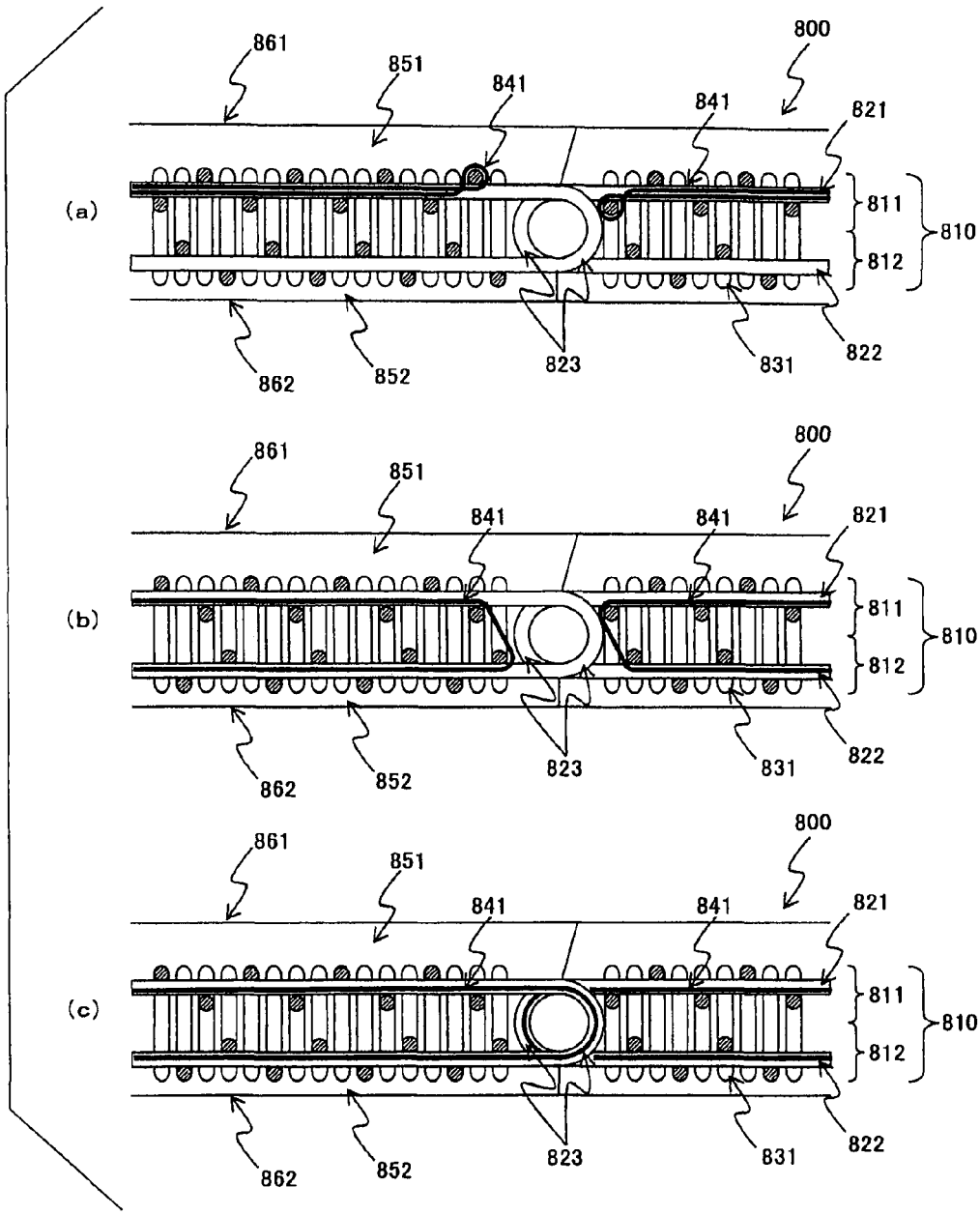
FIG. 8 is a cross-sectional view in the length direction of a further exemplary press felt for papermaking according to the present invention.

FIGS. 8(*a*) to 8(*c*) are cross-sectional views in the length direction showing another example of a press felt for papermaking according to the present invention. The felt 800 is formed by integrally laminating a top batt fiber layer 851 on a wet paper web-side surface 861 of a base fabric 810 and a bottom batt fiber layer 852 on a roll-side surface 862 thereof by needling. The felt 800 is a seamed felt in which, in the base fabric 810, a yarn used as ground warp yarns 821 and 822 is folded back to form an end connection loop 823 at each end in the length direction. The seamed felt is structured such that, after setting between the rolls of the papermaking machine, the end connection loops 823 are meshed with each other to form a common hole, through which a core line is inserted to connect endlessly. The base fabric 810 has a warp double structure in which the ground warp yarn 821 on the wet paper web-side surface 861 and the ground warp yarn 822 on the roll-side surface 862 overlap each other in its thickness direction to form a laminate of a wet paper web-side layer 811 and a roll-side layer 812 by the respective upper and lower ground warp yarns 821 and 822.

Additionally, in the base fabric 810, in addition to the ground warp yarns 821 and 822, an additional warp yarn 841 is arranged in such a manner so as to be interwoven into the wet paper web-side layer 811 of the base fabric (FIG. 8(*a*)) and/or the roll-side layer 812 thereof (not shown).

In addition, in FIGS. 8(*b*) and 8(*c*), since the additional warp yarn 841 is arranged on both of the wet paper web-side layer 811 of the base fabric and the roll-side layer 812 thereof, fibers forming the top batt fiber layer 851 and the bottom batt fiber layer 852 twine themselves around the ground warp yarns 821, 822, a ground weft yarn 831, and furthermore, the additional warp yarn 841 to be firmly retained in the base fabric, allowing for the prevention of fiber shedding. In all of FIGS. 8(*a*) to 8(*c*), the additional warp yarn 841 is not connected at the seam portion, so that felt splitting (flap processing) efficiency can be significantly improved.

The additional warp yarn 841 in FIGS. 8(*a*) to 8(*c*) is shown as the same weave as the ground warp yarns 821 and 822, but alternatively can be arranged as a separate weave independent from the ground warps 821 and 822.

In embodiments of the press felt for papermaking according to the present invention, when there is provided an endless felt that uses monofilament yarns as warp and weft yarns forming a base fabric of the felt to appropriately secure a spatial volume in the felt so as to maintain water permeability and compressibility, it can be provided in such a manner that eliminates a problem of fiber shedding on a wet paper web-side surface and a roll-side surface and neither significantly increases working steps nor changes the physical properties of the base fabric of the felt. Additionally, in embodiments, in an open-ended felt using monofilament yarns as warp and weft yarns forming a base fabric of the felt, in addition to the above advantageous effects, felt splitting work (flap processing) efficiency can be greatly improved.

In the above detailed description, reference is made to exemplary embodiments of the invention. Obviously, numerous modifications and variations of the present invention are possible in light of the above teachings. It is therefore to be understood that within the scope of the appended claims, the invention may be practiced otherwise than as specifically described herein.

The invention claimed is:

1. A press felt for papermaking, comprising:

at least one batt fiber layer; and a base fabric;

wherein:

the at least one batt fiber layer is integrated into the base fabric;

the base fabric comprises a wet paper web-side surface and a roll-side surface;

the base fabric comprises at least one ground warp yarn, at least one ground weft yarn, and at least one additional warp yarn;

the at least one ground warp yarn and the at least one ground weft yarn comprise monofilament yarns;

the at least one additional warp yarn comprises a material different from a material forming the at least one ground warp yarn;

the at least one additional warp yarn is arranged so that, when the base fabric is viewed in cross-section in a warp yarn direction, the at least one additional warp yarn ascends toward the wet paper web-side surface and descends toward the roll-side surface, relative to the at least one ground warp yarn;

the at least one additional warp yarn comprises a yarn assembly material obtained by assembling a plurality of at least one of staple yarns and filament yarns;

the at least one ground warp yarn is folded back at an end of the base fabric in the warp yarn direction to form an end connection loop; and the at least one additional warp yarn is provided entirely on a wet paper web-side of the end connection loop in a vicinity of the end connection loop.

2. A press felt for papermaking, comprising:

at least one batt fiber layer; and a base fabric;

wherein:

the at least one batt fiber layer is integrated into the base fabric;

the base fabric comprises a wet paper web-side surface and a roll-side surface;

the base fabric comprises at least one ground warp yarn, at least one ground weft yarn, and at least one additional warp yarn;

the at least one ground warp yarn and the at least one ground weft yarn comprise monofilament yarns;

the at least one additional warp yarn comprises a material different from a material forming the at least one ground warp yarn;

the at least one additional warp yarn is arranged so that, when the base fabric is viewed in cross-section in a warp yarn direction, the at least one additional warp yarn ascends toward the wet paper web-side surface and descends toward the roll-side surface, relative to the at least one ground warp yarn;

the at least one additional warp yarn comprises a yarn assembly material obtained by assembling a plurality of at least one of staple yarns and filament yarns;

the at least one ground warp yarn is folded back at an end of the base fabric in the warp yarn direction to form an end connection loop; and the at least one additional warp yarn is provided entirely on a roll-side of the end connection loop in a vicinity of the end connection loop.

3. A press felt for papermaking, comprising:

at least one batt fiber layer; and a base fabric;

wherein:

the at least one batt fiber layer is integrated into the base fabric;

the base fabric comprises a wet paper web-side surface and a roll-side surface;

the base fabric comprises at least one ground warp yarn, at least one ground weft yarn, and at least one additional warp yarn;

the at least one ground warp yarn and the at least one ground weft yarn comprise monofilament yarns;

the at least one additional warp yarn comprises a material different from a material forming the at least one ground warp yarn;

the at least one additional warp yarn is arranged so that, when the base fabric is viewed in cross-section in a warp yarn direction, the at least one additional warp yarn ascends toward the wet paper web-side surface and descends toward the roll-side surface, relative to the at least one ground warp yarn;

the at least one ground warp yarn is folded back at an end of the base fabric in the warp yarn direction to form an end connection loop; and the at least one additional warp yarn is provided entirely on a wet paper web-side of the end connection loop in a vicinity of the end connection loop.

4. A press felt for papermaking, comprising:

at least one batt fiber layer; and a base fabric;

wherein:

the at least one batt fiber layer is integrated into the base fabric;

the base fabric comprises a wet paper web-side surface and a roll-side surface;

the base fabric comprises at least one ground warp yarn, at least one ground weft yarn, and at least one additional warp yarn;

the at least one ground warp yarn and the at least one ground weft yarn comprise monofilament yarns;

the at least one additional warp yarn comprises a material different from a material forming the at least one ground warp yarn;

the at least one additional warp yarn is arranged so that, when the base fabric is viewed in cross-section in a warp yarn direction, the at least one additional warp yarn ascends toward the wet paper web-side surface and descends toward the roll-side surface, relative to the at least one ground warp yarn;

the at least one ground warp yarn is folded back at an end of the base fabric in the warp yarn direction to form an end connection loop; and the at least one additional warp yarn is provided entirely on a roll-side of the end connection loop in a vicinity of the end connection loop.

5. A press felt for papermaking, comprising:

at least one batt fiber layer; and a base fabric;

wherein:

the at least one batt fiber layer is integrated into the base fabric;

the base fabric comprises a wet paper web-side surface and a roll-side surface;

the base fabric comprises at least one ground warp yarn, at least one ground weft yarn, and at least one additional warp yarn;

the at least one ground warp yarn and the at least one ground well yarn comprise monofilament yarns;

the at least one additional warp yarn comprises a material different from a material forming the at least one ground warp yarn;

the at least one additional warp yarn is arranged so that, when the base fabric is viewed in cross-section in a warp yarn direction, the at least one additional warp yarn ascends toward the wet paper web-side surface and descends toward the roll-side surface, relative to the at least one ground warp yarn;

the at least one additional warp yarn comprises a yarn assembly material obtained by assembling a plurality of at least one of staple yarns and filament yarns; and at least one additional warp yarn is folded back at an end of the base fabric in the warp yarn direction to form an end connection loop.

6. A press felt for papermaking, comprising:

at least one batt fiber layer; and a base fabric;

wherein:

the at least one batt fiber layer is integrated into the base fabric;

the base fabric comprises a wet paper web-side surface and a roll-side surface;

the base fabric comprises at least one ground warp yarn, at least one ground weft yarn, and at least one additional warp yarn;

the at least one ground warp yarn and the at least one ground weft yarn comprise monofilament yarns;

the at least one additional warp yarn comprises a material different from a material forming the at least one ground warp yarn;

the at least one additional warp yarn is arranged so that, when the base fabric is viewed in cross-section in a warp yarn direction, the at least one additional warp yarn ascends toward the wet paper web-side surface and descends toward the roll-side surface, relative to the at least one ground warp yarn; and at least one additional warp yarn is folded back at an end of the base fabric in the warp yarn direction to form an end connection loop.

7. A press felt for papermaking, comprising:

at least one batt fiber layer; and a base fabric;

wherein:

the at least one batt fiber layer is integrated into the base fabric;

the base fabric comprises a wet paper web-side surface and a roll-side surface;

the base fabric comprises at least one ground warp yarn, at least one ground weft yarn, and at least one additional warp yarn;

the at least one ground warp yarn and the at least one ground weft yarn comprise monofilament yarns;

the at least one additional warp yarn comprises a material different from a material forming the at least one ground warp yarn;

the at least one additional warp yarn is arranged so that, when the base fabric is viewed in cross-section in a warp yarn direction, the at least one additional warp yarn ascends toward the wet paper web-side surface and descends toward the roll-side surface, relative to the at least one ground warp yarn;

the at least one ground warp yarn has a thickness of from 500 to 3,000 dtex;

the at least one ground weft yarn has a thickness of from 500 to 2,700 dtex; and the at least one additional warp yarn comprises a monofilament yarn having a thickness of from 200 to 800 dtex.

8. A press felt for papermaking, comprising:

at least one batt fiber layer; and a base fabric;

wherein:

the at least one batt fiber layer is integrated into the base fabric;

the base fabric comprises a wet paper web-side surface and a roll-side surface;

the base fabric comprises at least one ground warp yarn, at least one ground weft yarn, and at least one additional warp yarn;

the at least one ground warp yarn and the at least one ground weft yarn comprise monofilament yarns;

the at least one additional warp yarn comprises a material different from a material forming the at least one ground warp yarn;

the at least one additional warp yarn is arranged so that, when the base fabric is viewed in cross-section in a warp yarn direction, the at least one additional warp yarn ascends toward the wet paper web-side surface and descends toward the roll-side surface, relative to the at least one ground warp yarn;

the at least one ground warp yarn has a thickness of from 500 to 3,000 dtex;

the at least one ground weft yarn has a thickness of from 500 to 2,700 dtex; and the at least one additional warp yarn comprises a twisted yarn comprising monofilament yarns having a thickness of from 100 to 500 dtex.

9. A press felt for papermaking, comprising:

at least one batt fiber layer; and a base fabric;

wherein:

the at least one batt fiber layer is integrated into the base fabric;

the base fabric comprises a wet paper web-side surface and a roll-side surface;

the base fabric comprises at least one ground warp yarn, at least one ground weft yarn, and at least one additional warp yarn;

the at least one ground warp yarn and the at least one ground weft yarn comprise monofilament yarns;

the at least one additional warp yarn comprises a material different from a material forming the at least one ground warp yarn;

the at least one additional warp yarn is arranged so that, when the base fabric is viewed in cross-section in a warp yarn direction, the at least one additional warp yarn ascends toward the wet paper web-side surface and descends toward the roll-side surface, relative to the at least one ground warp yarn;

the at least one ground warp yarn is folded back at an end of the base fabric in the warp yarn direction to form an end connection loop; and the at least one additional warp yarn is folded back at an end of the base fabric in the warp yarn direction to form an end connection loop.

* * * * *